US010549818B2

(12) United States Patent
Merchant et al.

(10) Patent No.: US 10,549,818 B2
(45) Date of Patent: Feb. 4, 2020

(54) LOW MOTION SEMI-SUBMERSIBLE

(71) Applicant: Keppel Offshore & Marine Technology Centre Pte Ltd, Singapore (SG)

(72) Inventors: Aziz Amirali Merchant, Singapore (SG); Anis Altaf Hussain, Singapore (SG); Ankit Kumar Choudhary, Singapore (SG); Wei Xu, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 0 days.

(21) Appl. No.: 16/066,034

(22) PCT Filed: Dec. 27, 2016

(86) PCT No.: PCT/SG2016/050620
§ 371 (c)(1),
(2) Date: Jun. 25, 2018

(87) PCT Pub. No.: WO2017/111703
PCT Pub. Date: Jun. 29, 2017

(65) Prior Publication Data

US 2019/0031291 A1 Jan. 31, 2019

(30) Foreign Application Priority Data

Dec. 24, 2015 (SG) ..... 10201510660

(51) Int. Cl.

| | |
|---|---|
| ***B63B 1/10*** | (2006.01) |
| ***B63B 35/44*** | (2006.01) |
| ***B63B 39/10*** | (2006.01) |
| ***B63B 1/12*** | (2006.01) |
| ***B63B 1/04*** | (2006.01) |
| ***B63B 39/00*** | (2006.01) |

(52) U.S. Cl.
CPC ..... *B63B 1/107* (2013.01); *B63B 1/041* (2013.01); *B63B 1/121* (2013.01);
(Continued)

(58) Field of Classification Search
CPC ..... B63B 35/00; B63B 35/44; B63B 21/00; B63B 21/24; B63B 21/50; B63B 21/502;
(Continued)

(56) References Cited

U.S. PATENT DOCUMENTS 3,919,957 A * 11/1975 Ray ..... B63B 35/4413 114/265
3,982,492 A * 9/1976 Steddum ..... B63B 35/4413 114/265
(Continued)

FOREIGN PATENT DOCUMENTS

GB 1065216 4/1967

OTHER PUBLICATIONS

International Search Report from Australian Patent Office dated Feb. 7, 2017 for relating International Application No. PCT/SG2016/050620.

(Continued)

*Primary Examiner* — Lars A Olson
(74) *Attorney, Agent, or Firm* — Baker Hostetler

(57) ABSTRACT

The present invention relates to a semi-submersible offshore structure. More particularly, the invention relates to a low motion semi-submersible offshore structure that has improved stability in deep water. The low motion semi-submersible experiences relatively lesser heave, pitch and wave motions compared to conventional semi-submersibles when the semi-submersible is operating in harsh offshore environments.

18 Claims, 18 Drawing Sheets

(52) U.S. Cl.
CPC ..... *B63B 35/4413* (2013.01); *B63B 39/00* (2013.01); *B63B 39/10* (2013.01); *B63B 2001/044* (2013.01); *B63B 2001/123* (2013.01)

(58) Field of Classification Search
CPC ..... B63B 35/4413; B63B 39/00; B63B 39/06; B63B 39/10; B63B 39/005; B63B 9/00; B63B 9/06; B63B 1/00; B63B 1/10; B63B 1/107; B63B 1/121; B63B 1/041
USPC ..... 114/264, 265
See application file for complete search history.

(56) References Cited

U.S. PATENT DOCUMENTS

| | | | | |
|---|---|---|---|---|
| 5,653,188 | A * | 8/1997 | Molin | B63B 35/4413 114/265 |
| 6,701,861 | B2 | 3/2004 | Key et al. | |
| 8,387,550 | B2 * | 3/2013 | Mansour | B63B 35/44 114/265 |
| 2004/0216657 | A1 | 11/2004 | Leverette et al. | |
| 2013/0092069 | A1 | 4/2013 | Xie et al. | |
| 2013/0319314 | A1 | 12/2013 | Wang et al. | |
| 2015/0060138 | A1 | 3/2015 | Vandenworm | |

OTHER PUBLICATIONS

Written Opinion from Australian Patent Office dated Feb. 7, 2017 for relating International Application No. PCT/SG2016/050620.
International Preliminary Report on Patentability from Australian Patent Office dated Nov. 1, 2017 for relating International Application No. PCT/SG2016/050620.

* cited by examiner

LOW MOTION SEMI-SUBMERSIBLE

CROSS REFERENCED APPLICATIONS

This application is a U.S. National Phase filing of PCT Application No. PCT/SG2016/050620 filed 27 Dec. 2016 that claims priority to Singapore Patent Application No. 10201510660T filed 24 Dec. 2015, both of which are hereby incorporated by reference as if set forth herewith.

FIELD OF THE INVENTION

The present invention relates to a semi-submersible offshore structure. More particularly, the invention relates to a low motion semi-submersible offshore structure that has improved stability in deep water.

BACKGROUND

Most of the conventional semi-submersible structures comprise a hull that has sufficient buoyancy to support a deck box or platform above the water surface. The hull typically comprises two substantially parallel pontoons and a plurality of vertically upstanding columns that extend from the pontoons to support the deck box above the water surface. The pontoons and portions of columns are submerged below the operational water line during norming operation.

FIG. 1 shows one of such conventional semi-submersible structures. The semi-submersible structure shown in FIG. 1 includes a plurality of main columns (1) and a plurality pencil columns (2) that support a deck box (3) above the water surface. The pencil columns (2) are provided to provide the semi-submersible with better motion control and as a result, higher uptime. Each of the main columns (1) consists of a fork shaped wave diverter (4) provided at one surface of the main columns for reducing the wave drift force on the semi-submersible. Although conventional semi-submersibles of such configuration may have acceptable motion responses in normal weather condition, their motion responses during severe weather conditions are typically excessive and unacceptable for some applications, that is, they still face a relatively large heave, pitch and wave motions when operating under severe weather conditions.

The conventional semi-submersible structure shown in FIG. 1 also includes a plurality of bracings (5). The bracings are to provide adequate structural integrity to the structure. However, such bracings often create undesirable characteristics, for example, hydrodynamic drag and create problems related to underslung loads.

Other challenges face by conventional semi-submersibles when operating under harsh offshore environmental conditions include unsymmetrical load distribution of the semi-submersible which makes it not ideal for mooring design. In particular, the total wind and current load in quartering sea could be about 40% more than at the head sea. The total wind and current load in the beam sea could be about 20% more than the loads at the head sea. As a result, the mooring design of a semi-submersible is greatly influenced by forces from the quartering sea. A conventional semi-submersible may utilize a mooring system that consists of a 12 point chain and 4 thrusters. This results in unsymmetrical load distribution on the semi-submersible and this in turns, makes it not ideal for mooring design.

Another conventional semi-submersible structure known in the art is one that comprises a ring pontoon, a plurality of vertically upstanding columns that extend from the pontoons to support a rectangular deck box above the water surface. The semi-submersible of this configuration has several drawbacks. One of which is that it has high mass due to large displacement of the semi-submersible and high added mass due to the semi-submersible's large skirts. The semi-submersible has a relatively high natural period and this shifts the Response Amplitude Operator (RAO) curve to the right. However, the mono-hull of the semi-submersible of this configuration does not have any heave second hump.

It is therefore desirable to provide a semi-submersible structure that seeks to address at least some of the problems encountered in conventional semi-submersibles, or at least to provide an alternative.

SUMMARY OF INVENTION

The problems in the art are solved and an advance in the art is made by a semi-submersible offshore structure in accordance with some embodiments of this invention. In one aspect of the present invention, a low motion semi-submersible offshore structure is provided. The low motion semi-submersible offshore structure comprises a deck box; a submersible lower hull comprising a ring pontoon having an annular pontoon body with a top surface, a bottom surface, an outer circumferential wall, an inner circumferential wall, and a plurality of spaced-apart through holes extending from the bottom surface of the ring pontoon to the top surface of the ring pontoon; a plurality of main columns extending upwardly from the pontoon body to the deck box for supporting the deck box above a water surface; and a plurality of pencil columns, each of the pencil columns having an upper end and a lower end, with each of the pencil columns positioned between two main columns and extending upwardly from the respective spaced-apart through hole to the deck box, and wherein each of the pencil columns having a water chamber provided within the pencil column for receiving water through the through hole and entrapping water within the pencil column for dampening pitch and wave motions of the semi-submersible during operation.

In accordance with some embodiments of this invention, each of the pencil columns further comprises a dampening means for dampening water that enters the pencil column.

In accordance with many embodiments of this invention, the dampening means is a second chamber provided within and at the upper end of the pencil column for entrapping air within the pencil column for use as a damper to the water entering the pencil column.

In accordance with a number of embodiments of this invention, the dampening means is a piston provided within and at the upper end of the pencil column for entrapping air within the pencil column for use as a damper to the water entering the pencil column.

In accordance with some embodiments of this invention, the water chamber extends through the entire length of the pencil column. In accordance with many embodiments of this invention, the low motion semi-submersible offshore structure further comprises means for introducing high pressure compressed air into the pencil columns for controlling flow of water within the pencil columns, wherein the said means is provided outside and proximate the upper end of the pencil column.

In accordance with some embodiments of this invention, the plurality of pencil columns extend radially inwardly toward a center vertical axis of the ring pontoon to the deck box.

In accordance with an embodiment of this invention, the semi-submersible offshore structure comprises four main columns and four pencil columns.

BRIEF DESCRIPTION OF THE DRAWINGS

The above advantages and features of a system in accordance with this invention are described in the following detailed description and are shown in the drawings:

FIG. 19(*a*) shows a perspective view of the semi-submersible; FIGS. 19(*b*) and 19(*c*) show various exploded views of the pontoon structure of the semi-submersible; FIG. 19(*d*) shows the top view of the upper hull; FIG. 19(*e*) shows the bottom view of the upper hull; FIG. 19(*f*) shows the arrangement of the main columns and pencil columns and the pontoon bulkheads; and FIG. 19(*g*) illustrates the major girder frames of the semi-submersible.

DETAILED DESCRIPTION

Figure 1:
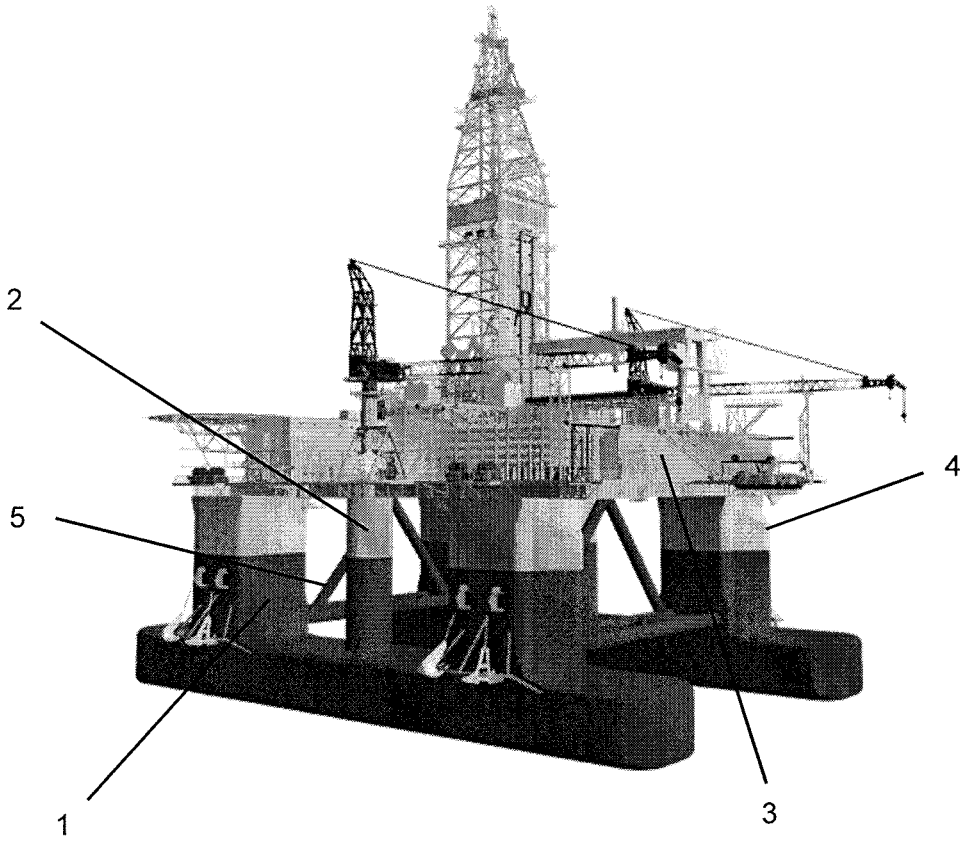
Figure 1 (Prior Art)
FIG. 1 illustrates a conventional semi-submersible structure in accordance with the prior art.
Figure 2:
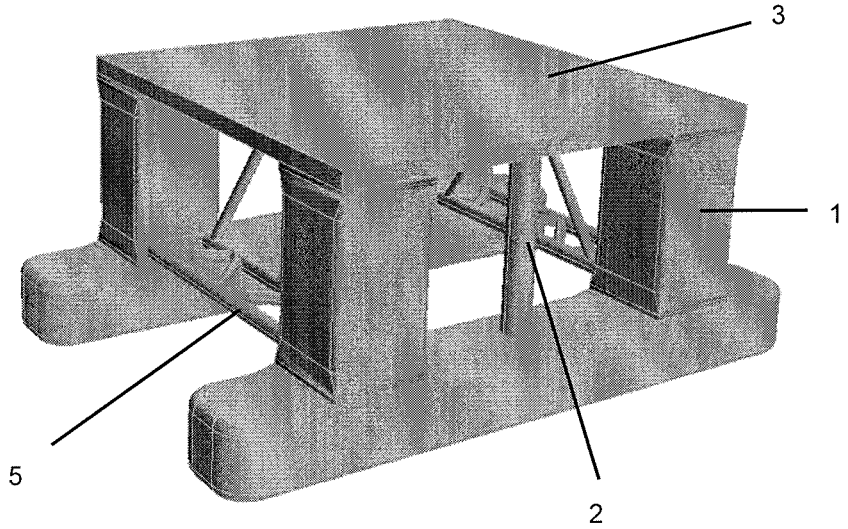
Figure 2 (Prior Art)
FIG. 2 illustrates another view of the conventional semi-submersible structure of FIG. 1 in accordance with the prior art.

In the following description, numerous specific details are set forth in order to provide a thorough understanding of various illustrative embodiments of the invention. It will be understood, however, to one skilled in the art, that embodiments of the invention may be practiced without some or all of these specific details.

Referring to drawings by numerals of reference, there is shown a low motion semi-submersible structure (10) for use in offshore applications, such as for offshore oil and gas drilling and production. The structure (10) comprises a deck box (11) forming an upper hull and a submersible lower hull comprising a ring pontoon (12) having an annular pontoon body with a top surface (13), a bottom surface (14), an outer circumferential wall (15), an inner circumferential wall (16), and a plurality of space-apart through holes (17) extending from the bottom surface of the ring pontoon to the top surface of the ring pontoon. The semi-submersible structure (10) has a plurality of main columns (18) extending upwardly from the pontoon body to the deck box (11) for supporting the deck box (11) above a water surface and a plurality of pencil columns (19) with each extending upwardly from a respective spaced-apart through hole (17) to the deck box (11). Each of the pencil columns (19) has an upper end and a lower end. The upper end can be an open end or a closed end which comes in contact with the deck box (11). The lower end is an open end that comes in contact with the through hole (17) at the top surface of the ring pontoon (12).

Each of the pencil columns (19) has a water chamber (20) provided within the pencil column that allows water to flow in and out of the pencil column through the through hole (17) and entrapping water within the pencil column for dampening pitch and wave motions of the semi-submersible during operation. Each of the pencil columns (19) further comprises a dampening means for dampening water that enters the pencil column (19).

Figure 4:
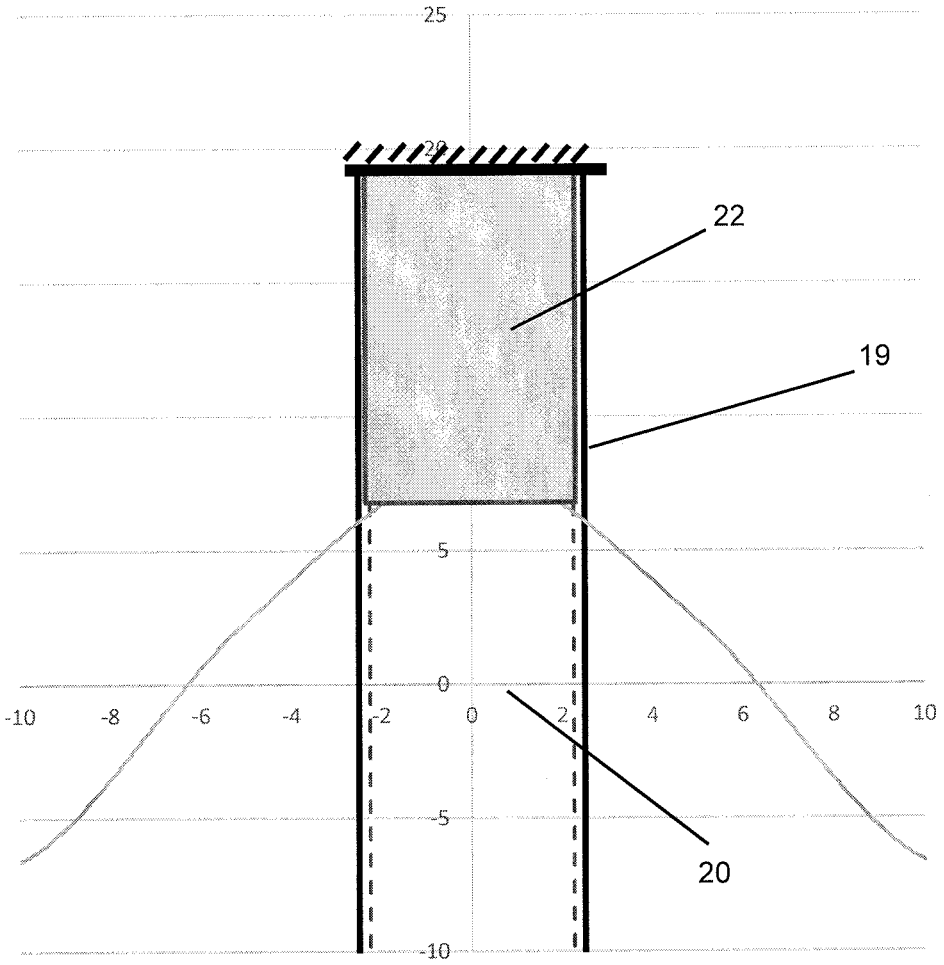
FIG. 4 illustrates a configuration of a pencil column in accordance with an embodiment of the present invention.
Figure 5:
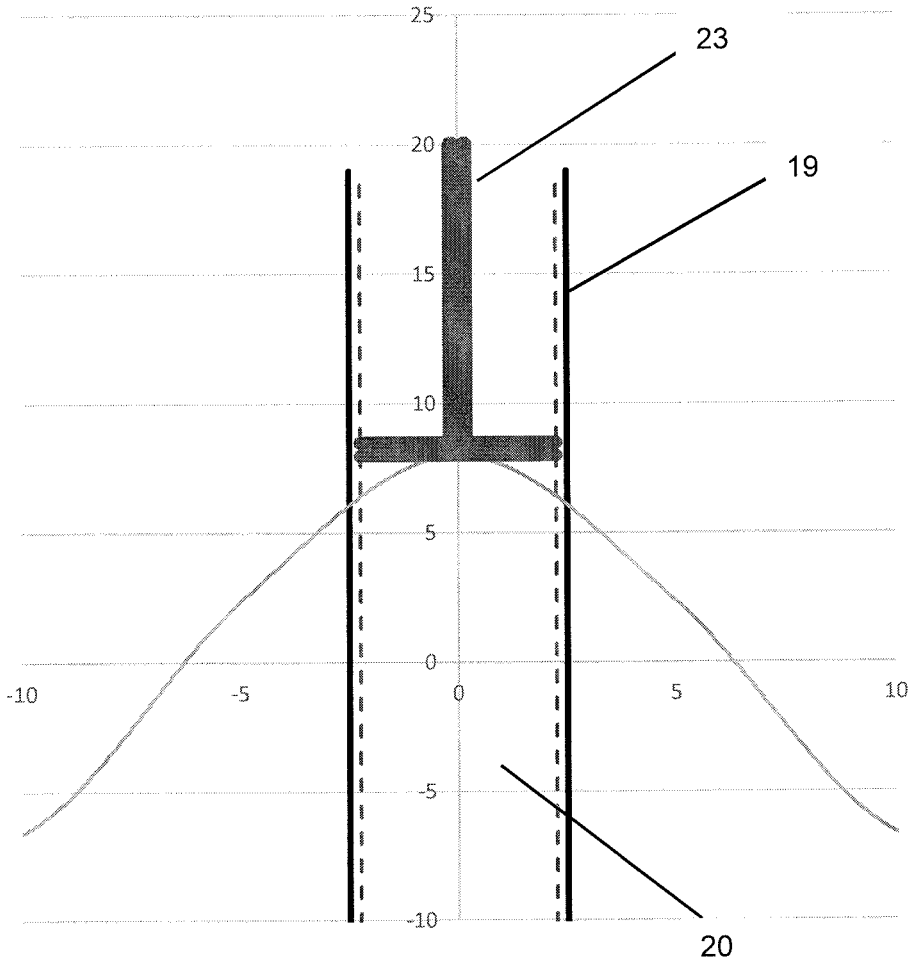
FIG. 5 illustrates a configuration of a pencil column in accordance with another embodiment of the present invention.
Figure 6:
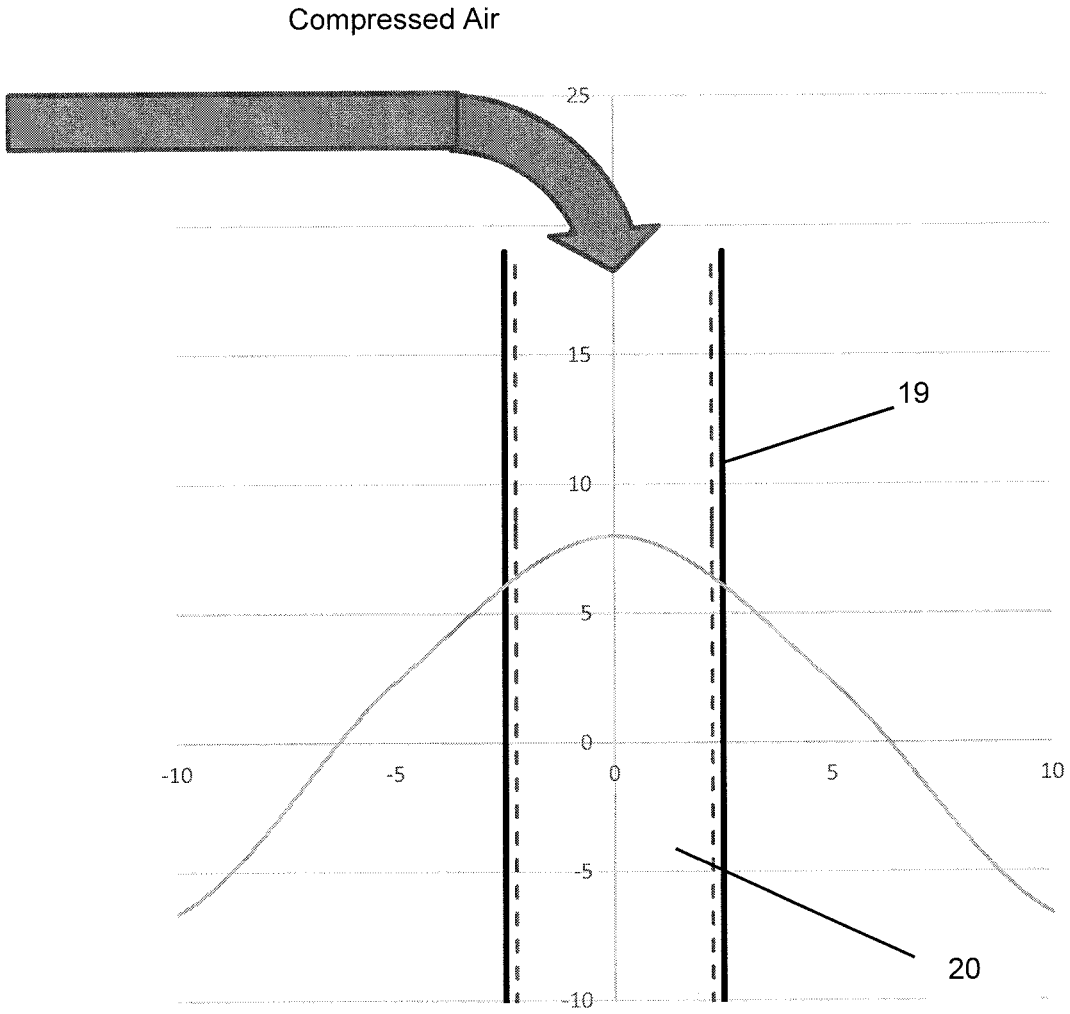
FIG. 6 illustrates a configuration of a pencil column in accordance with yet another embodiment of the present invention.

The pencil columns (19) in accordance with some embodiments of the present invention may take several forms. Some example in accordance with various embodiments are shown in FIGS. 4-6. Referring now to FIG. 4, there is shown an embodiment in which the pencil column (19) comprises the water chamber (20) and a second chamber (22) which acts as a dampening means for dampening the water entering the pencil column (19). The second chamber (22) is provided within and proximate the upper end of the pencil column (19). The area beneath the second chamber is the water chamber (20) for entrapping water within the pencil column (19). The second chamber (22) entraps air within the second chamber to act as a damper to the water entering the pencil column (19) through the open end at the lower end of the pencil column (19) and into the water chamber (20). The inner and outer surfaces of the pencil column (19), the water chamber (20) and the second chamber (22) may be treated to prevent the entrapped air from escaping the second chamber (22). Any suitable treatment known in the art may be employed without departing from the scope of the present invention.

Referring now to FIG. 5, there is shown a second embodiment in which the pencil column (19) comprises a piston (23) as the dampening means. The piston (23) is provided within and proximate the upper end of the pencil column (19). The piston may be driven by any suitable means known in the art including, but not limited to, pneumatic, hydraulic and jacking system. In this embodiment, the piston (23) is driven in an up and down motion to create an air chamber (24) proximate the upper end of the pencil column (19). The air chamber (24) acts as a damper to the water entering the pencil column (19) through the open end at the lower end of the pencil column (19).

Referring now to FIG. 6, there is shown a further embodiment in which the water chamber (20) extends through the entire length of the pencil column (19). The pencil column (19) comprises a means for introducing high pressure compressed air into the pencil columns for controlling the flow of water within the pencil column (19). The said means (not shown) is provided outside and proximate the upper end of the pencil column (19). The manner in which high pressure compressed air is introduced into the pencil column (19) may take any suitable form. Any suitable means known in the art may be employed to introduce high pressure compressed air into the pencil column without departing from the scope of the invention. In one embodiment, the said means is a system comprising a conduit that is connected to the pencil column (19) and a pump for pumping high pressure compressed air into the pencil column (19).

Figure 3A:
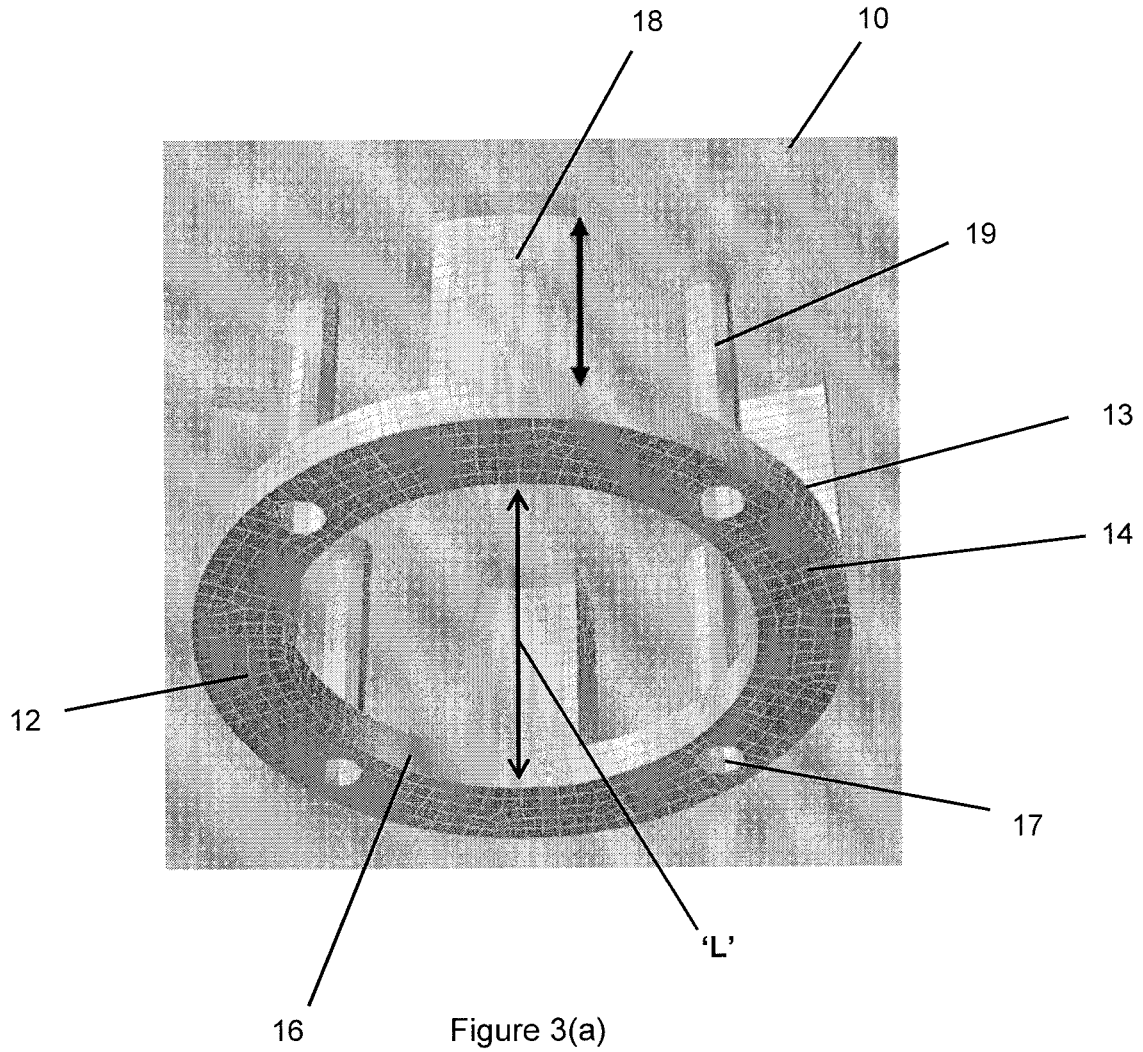
FIGS. 3(*a*) and 3(*b*) illustrate a low motion semi-submersible in accordance with an embodiment of the present invention.
Figure 3B:
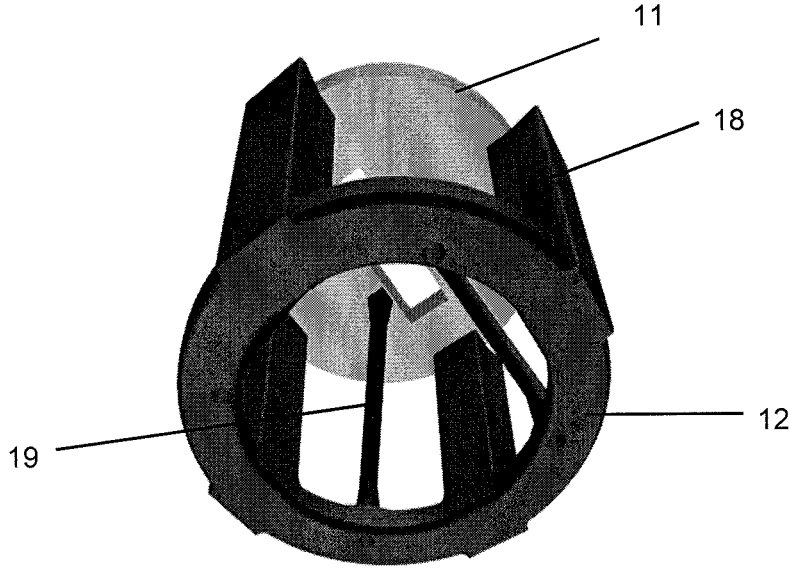
Figure 7:
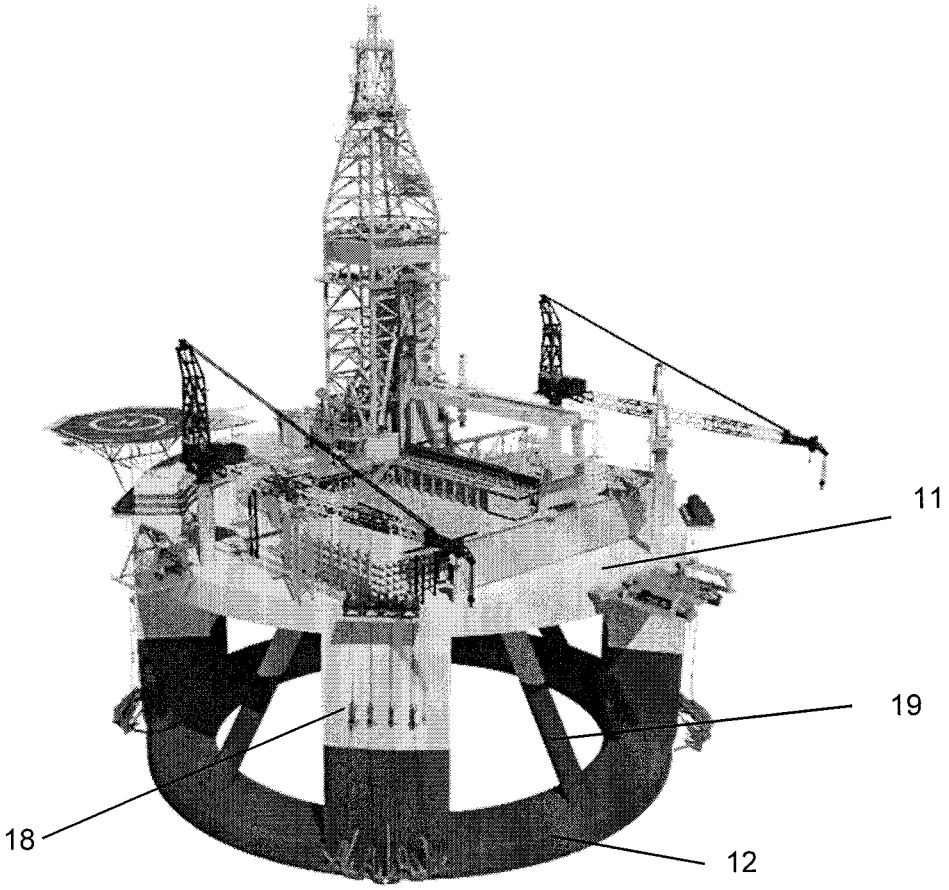
FIG. 7 illustrates a low motion semi-submersible in accordance with an embodiment of the present invention.

In one embodiment, the plurality of pencil columns (19) extends upwardly from the respective spaced-apart through hole in an upright position. An exemplary embodiment of this configuration is shown in FIG. 3. In another embodiment, the plurality of pencil columns (19) extends radially inwardly toward a center vertical axis of the ring pontoon (12) and the deck box (11). An exemplary embodiment of this configuration is shown in FIG. 7.

The pencil column (19) generally has a width that is narrower than the main column (18). In one embodiment, the pencil column (19) has an internal diameter of 5 to 7 m. The water chamber (20) within the pencil column (19) has an internal diameter of 4 to 6.5 m. The pencil column (19) can be of any suitable shape. In one embodiment, the pencil column has, over the entire length, a substantially circular cross-section.

Figure 10:
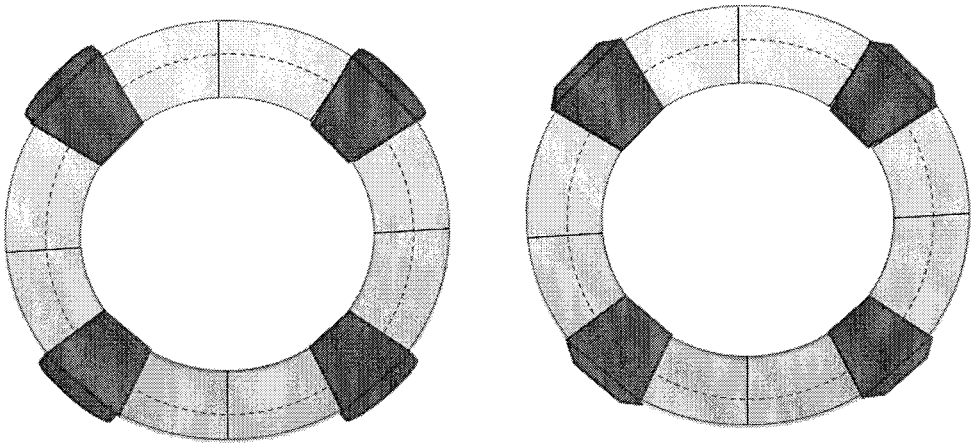
FIG. 10 illustrates the innovative shape of the main columns in accordance with some embodiments of the invention which is radial and unequal sided pentagon, to have lesser vortex induced motions (VIM) as the vortex generated will not be uniformly so strong and will result in negligible vortex induced motions (VIM).
Figure 11:
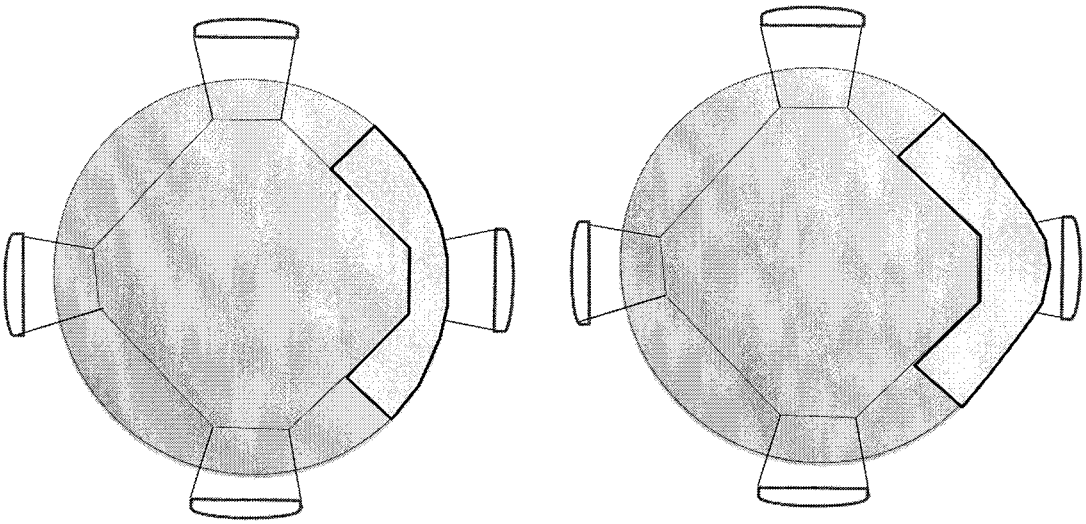
FIG. 11 illustrates the unique shape of LQ block which minimizes wind loading and save fuel if the semi-submersible is on DO. It will also save mooring system cost if it is used on a moored semi-submersible.

Each of the main columns (18) extends upwardly from ring pontoon in an upright position. The main columns (18) can be of any suitable shape, size, width and height. In one embodiment, the main column has, over the entire length, a substantially trapezoidal or rectangular cross-section. Other shapes may be employed without departing from the scope of the present invention. FIG. 10 show some in accordance with some embodiments of the main columns. In one embodiment, the main columns are radial and unequal sided pentagon, to have lesser vortex induced motions (VIM) as the vortex generated will not be uniformly so strong and will result in negligible vortex induced motions (VIM). FIG. 11 illustrates the unique shape of LQ block which minimizes wind loading and save fuel if the semi-submersible is on DO. It will also save mooring system cost if it is used on a moored semi-submersible.

In one embodiment, the main columns (18) and the pencil columns (19) have substantially the same height. In other embodiments, for example, the embodiment shown in FIG. 7, the main columns (18) and the pencil columns (19) may have a different height. The height of the main columns and pencil columns varies according to the structure design to provide enough air gap suitable to operate in a given location to avoid waves hitting the deck box. In some embodiments, the height varies between 20 m and 50 m.

Figure 8:
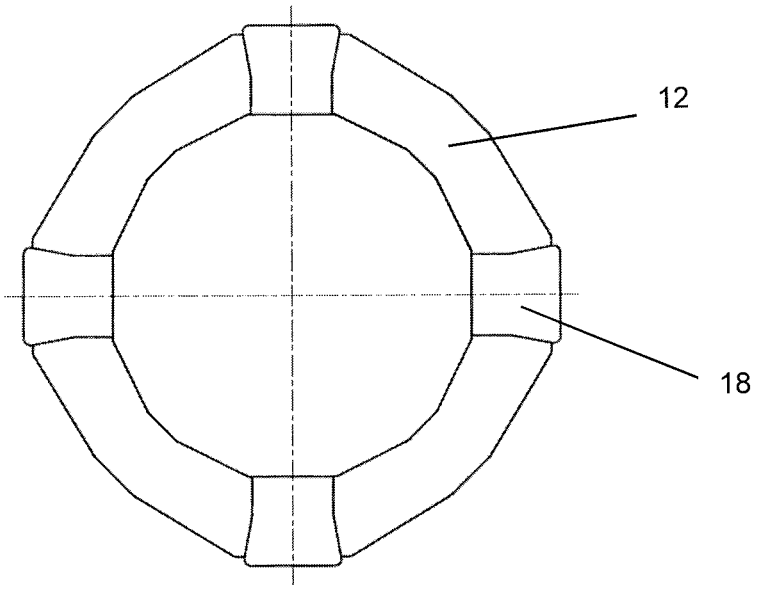
FIGS. 8-9 illustrate some exemplary arrangements of the main columns in accordance with embodiments of the present invention.
Figure 9:
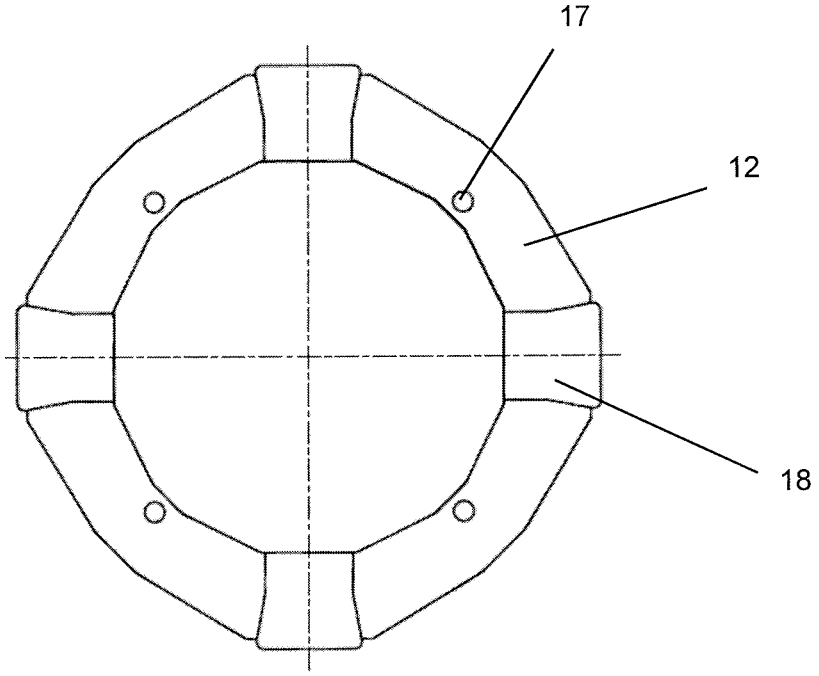

Any suitable number of main columns (18) and pencil columns (19) may be employed without departing from the scope of the invention. In one embodiment, the semi-submersible comprises at least four main columns (18) and at least four pencil columns (19). The main columns (18) and the pencil columns (19) may be arranged in any suitable manner. FIGS. 8-9 illustrate some exemplary arrangements of the main columns (19). Preferably, the main columns (19) are arranged in a manner such as to provide symmetrical load to the semi-submersible structure. Preferably, each of the pencil columns (19) is arranged between two main columns (see FIG. 3) in an alternate manner.

Figure 12:
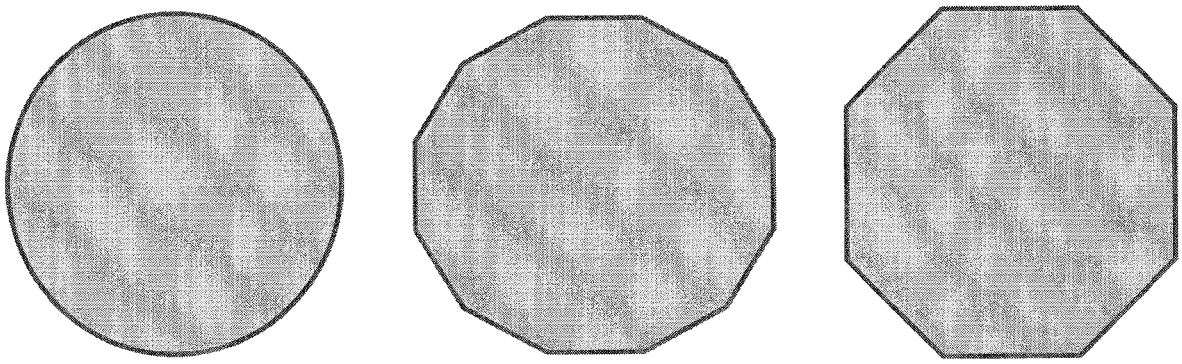
FIG. 12 illustrates other possible configurations of the ring pontoon of the semi-submersible in accordance with various embodiments of the present invention.

The ring pontoon (12) of the present invention can be of any suitable shape, size and height. FIG. 12 shows some exemplary configurations of the ring pontoon of the present invention. The configurations include ring pontoon of a circular and polygonal shape. The polygonal shaped pontoon can have any desired number of sides without departing from the present invention. Some exemplary embodiments include, but not limited to, 20-sided, 16-sided, 12-sided or 8-sided polygonal shaped pontoon. The semi-submersible of these configurations has the advantage of ease of construction for both the pontoon and the deck box (or upper hull).

In one embodiment, the ring pontoon (12) has an outer diameter ranging from 90 to 110 m. The inner diameter of the ring pontoon ranges from 65 to 85 m.

Due to the manner in which the ring pontoon (12) is shaped and sized, the drag coefficient (Cd) of the ring pontoon (12) is relatively lower than the drag coefficient of a conventional semi-submersible with two substantially parallel pontoons. The Cd of the ring pontoon (12) of the present invention ranges from 0.3 to 1.2, whilst the Cd of a conventional semi-submersible with two parallel pontoons is about 2.2. The circular shaped ring pontoon of the present invention significantly reduces current load and provides a more symmetrical load to the semi-submersible.

The deck box (11) can be of the same or different shape and size as the ring pontoon (12). In a shown embodiment, the deck box (11) and the ring pontoon (12) have the same shape and are substantially of the same size. In a preferred embodiment, the deck box (11) is of a circular or polygonal shape.

Due to the manner in which the deck box (11) is shaped and sized, the drag coefficient (Cd) of the circular or polygonal shaped deck box (11) of the present invention is relatively lower than the drag coefficient of a conventional semi-submersible with a square deck box. The Cd of the deck box (11) of the present invention ranges from 0.3 to 1.2, whilst the Cd of a conventional semi-submersible with a square deck box is 2.2. A circular or polygonal shaped deck box significantly reduces wind load and provides a more symmetrical load to the semi-submersible.

Referring to FIG. 3, the low motion semi-submersible in accordance with an embodiment of the present invention is able to achieve a heave second hump of less than 0.15 m/m, a heave natural period of about 19.3 to 20.5 seconds, and an operability of about 85 to 90%. The semi-submersible has a draft of about 34 to 40 m and a pontoon depth of 6 to 10 m. This allows the semi-submersible to be submerged up to 40% deeper as compared to a conventional semi-submersible.

Figure 13:
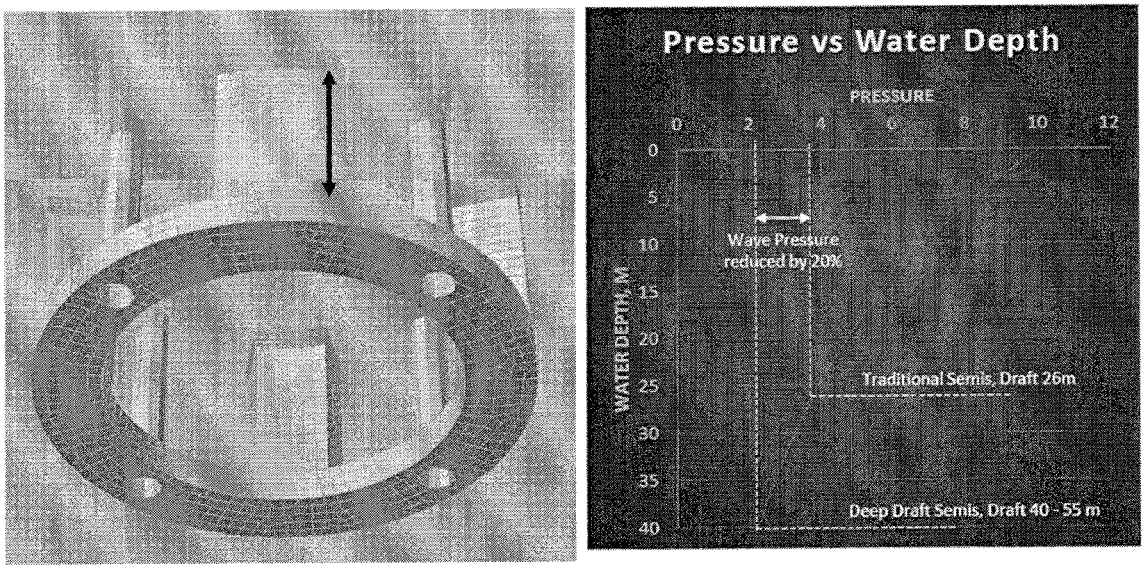
FIG. 13 shows the change in wave pressure as the water depth increases for a deep draft semi-submersible and a conventional semi-submersible.

FIG. 13 is a graph showing the change in wave pressure as the water depth increases for a deep draft semi-submersible (draft of about 40 to 50 m) and a conventional semi-submersible having a draft of about 26 m. It can be seen from the graph that the wave pressure is reduced by about 20% for a deep draft semi-submersible. This shows that wave energy reduces exponentially with water depth.

In the present invention, the ring pontoon (12) has an outer diameter of about 90 to 110 m. This provides the semi-submersible with added mass, of about 20% more than conventional semi-submersible. The column spacing (denotes as 'L' in FIG. 3) is reduced and this reduces the heave second hump by about 15%.

Figure 14A:
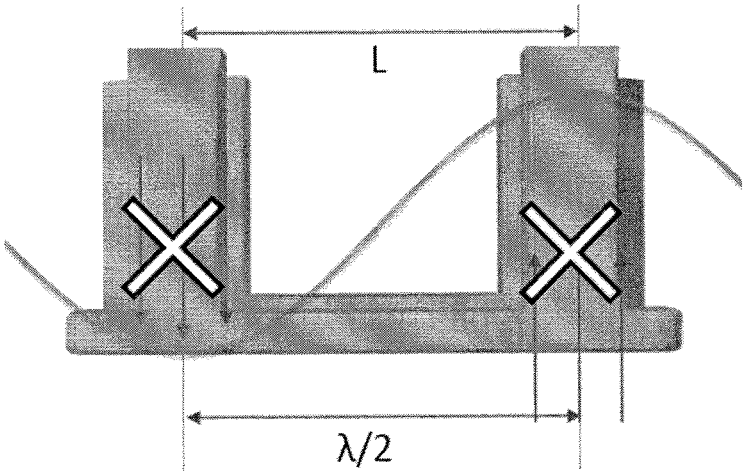
FIGS. 14(*a*) and 14(*b*) are graphs illustrating that the heave second hump value is reduced when smaller column spacing is utilized on a semi-submersible. The total heave force is cancelled out when the distance between the columns (L) are equal to half the length of the wave (λ), e.g. $L=\lambda/2$.
Figure 14B:
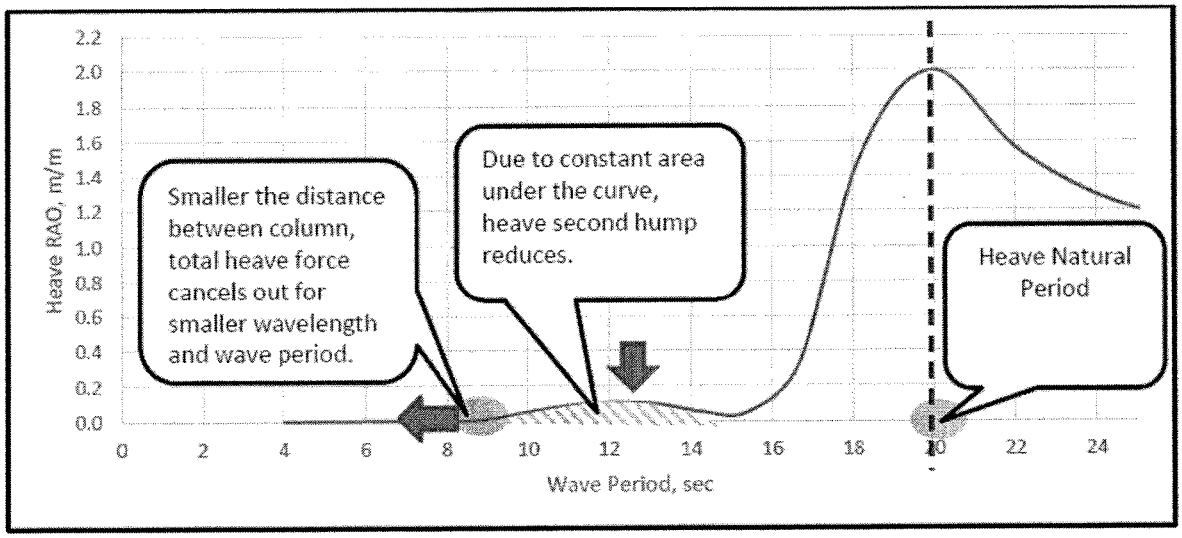

FIG. 14 illustrates the advantage of having reduced column spacing (thus motion cancellation). It is shown that the heave second hump value is reduced when smaller column spacing is utilized on a semi-submersible. The total heave force is cancelled out when the distance between the columns (L) are equal to half the length of the wave (λ), e.g. $L=\lambda/2$.

Figure 15:
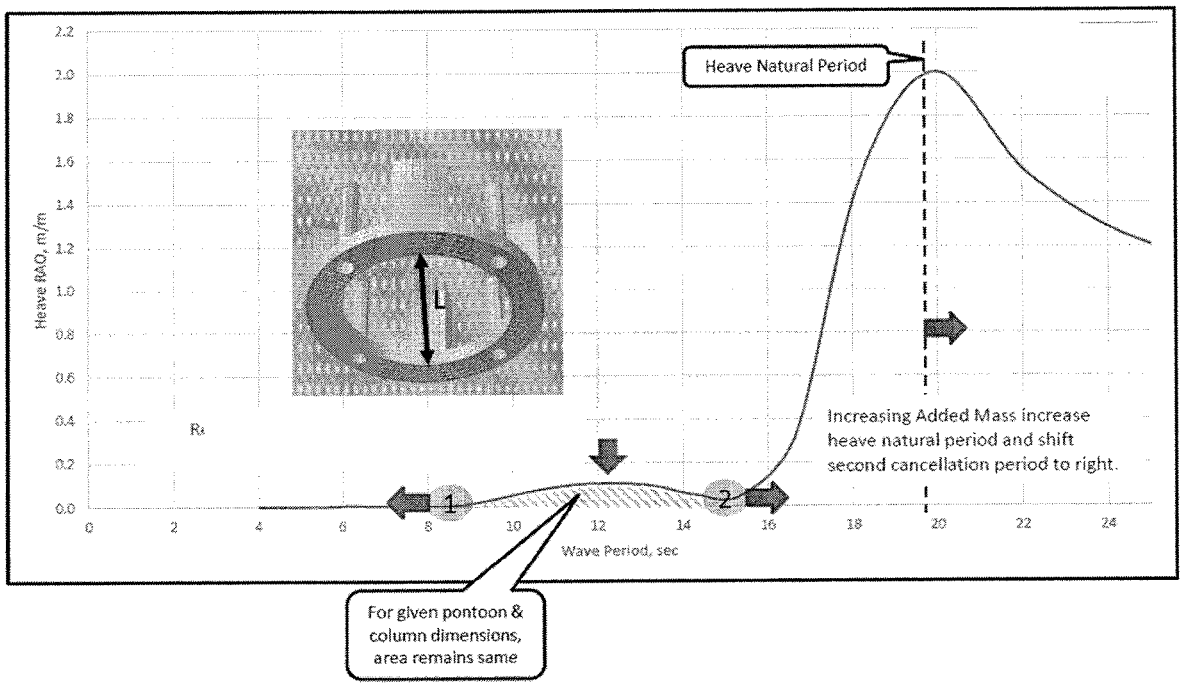
FIG. 15 is a graph showing that reducing the column spacing (L) will shift the cancellation period to the left of the graph and reduce the heave second hump value. In addition, increasing the added mass of the ring pontoon will increase the heave natural period and shift the second cancellation period to the right.

FIG. 15 illustrates the advantage of having an increased added mass and a reduced column spacing, which provides a combined improvement of about 35% over conventional semi-submersibles. The graph in FIG. 15 shows that reducing the column spacing (L) will shift the cancellation period to the left of the graph and reduce the heave second hump value. In addition, increasing the added mass of the ring pontoon will increase the heave natural period and shift the second cancellation period to the right.

The heave natural period may be expressed by the following equation:

$$T = 2 \cdot \pi \sqrt{\frac{M + A_{33}}{\rho g A_w}}$$

where T represents the heave natural period, M represents the mass (displacement) of the ring pontoon, p represents the density of water, g represents acceleration due to gravity, $A_{33}$ represents the added mass of the ring pontoon, and $A_w$ represents the waterplane area of the ring pontoon.

The water chamber (20) within the pencil column, having an internal diameter of about 4 to 6.5 m, provides a damping effect to the semi-submersible, thereby reducing the pitch, roll and heave motions of the semi-submersible by about 25% as compared to conventional semi-submersible. As the ring pontoon moves up and down, the pencil columns with the water chambers move along with it. The up and down motion of the pencil columns with the water chambers generates waves in the surrounding water which radiate energy away from the ring pontoon. The up and down motion of the pencil columns with the water chamber causes water to flow in and out of the water chamber. The water within the water chamber induces viscous damping by the friction and vortex shedding between the water and the pencil column's inner surface.

Figure 16:
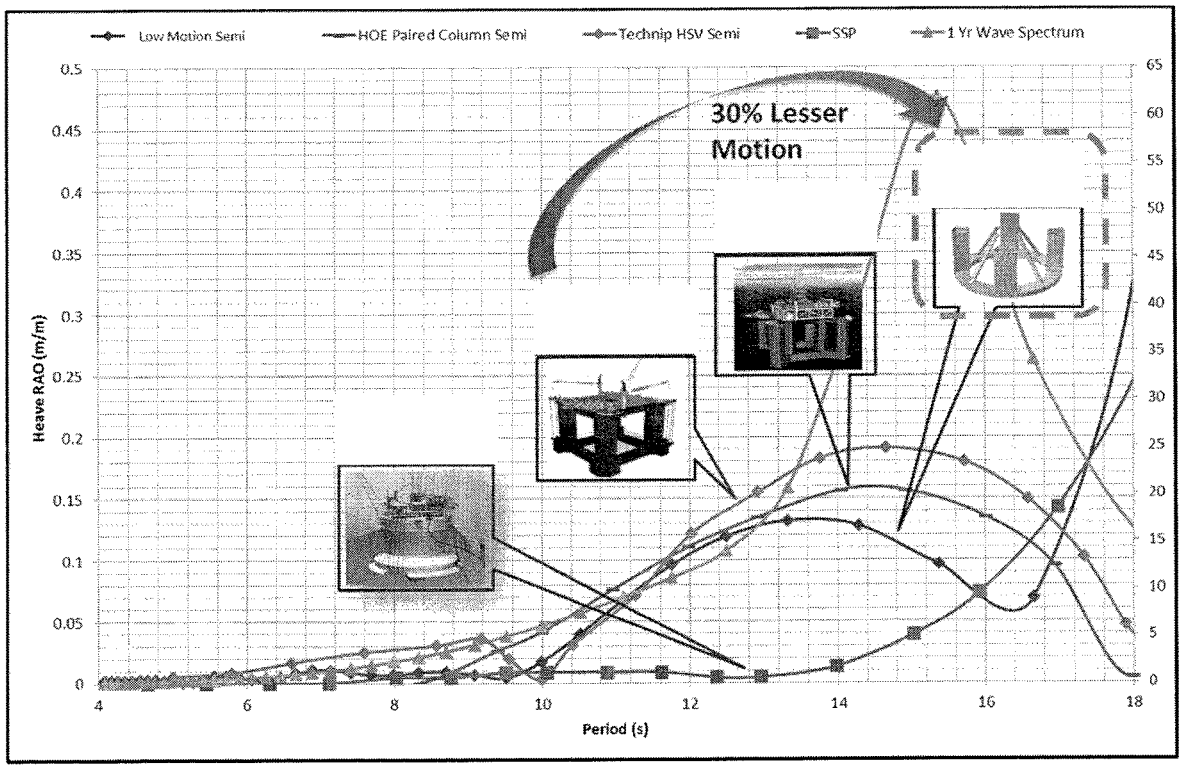
FIG. 16 is a graph showing the heave RAO (Response Amplitude Operators) against time of the low motion semi-submersible in accordance with some embodiments of the present invention and other conventional semi-submersible designs.

FIG. 16 is a graph showing the heave RAO (Response Amplitude Operators) against time of the low motion semi-submersible in accordance with an embodiment of the present invention and other conventional semi-submersible designs. The graph shows that the low motion semi-submersible of the present invention is capable of achieving a motion similar to a conventional semi-submersible with circular pontoon but with almost 8 times lesser displacement and steel weight. The readings of the draft, displacement, second hump and natural period of the various conventional semi-submersibles illustrated in FIG. 16 are set out in Table 1 below.

TABLE 1

| | SSP | Technip HSV Semi | HOE Paired Column Semi | LMS (present invention) |
|---|---|---|---|---|
| Draft (m) | 59.4 | 41 | 53.3 | about 40 |
| Displacement (mt) | 450,871 | 113,450 | 108,664 | about 71,100 |
| Second hump (m/m) | 0.01 | 0.18 | 0.19 | about 0.13 |
| Natural Period (s) | 23.0 | 21.9 | 22.4 | about 20.5 |

The low motion semi-submersible in accordance with an embodiment of the present invention is capable of achieving a heave second hump of less than 0.15 m/m and a heave natural period of about 19.3 to 20.5 seconds. The semi-submersible allows for use of Surface BOP to reduce operation costs for maintenance and inspection. Due to its efficiency and high uptime (of about 90%), the semi-submersible of the present invention is able to reduce the cost per well and this benefits the drilling contractors. The mooring system for use in harsh offshore environment is based on the number of moorings that are used and as lesser moorings are required, this will reduce the allocation of the CAPEX for thrusters and engine.

Figure 17:
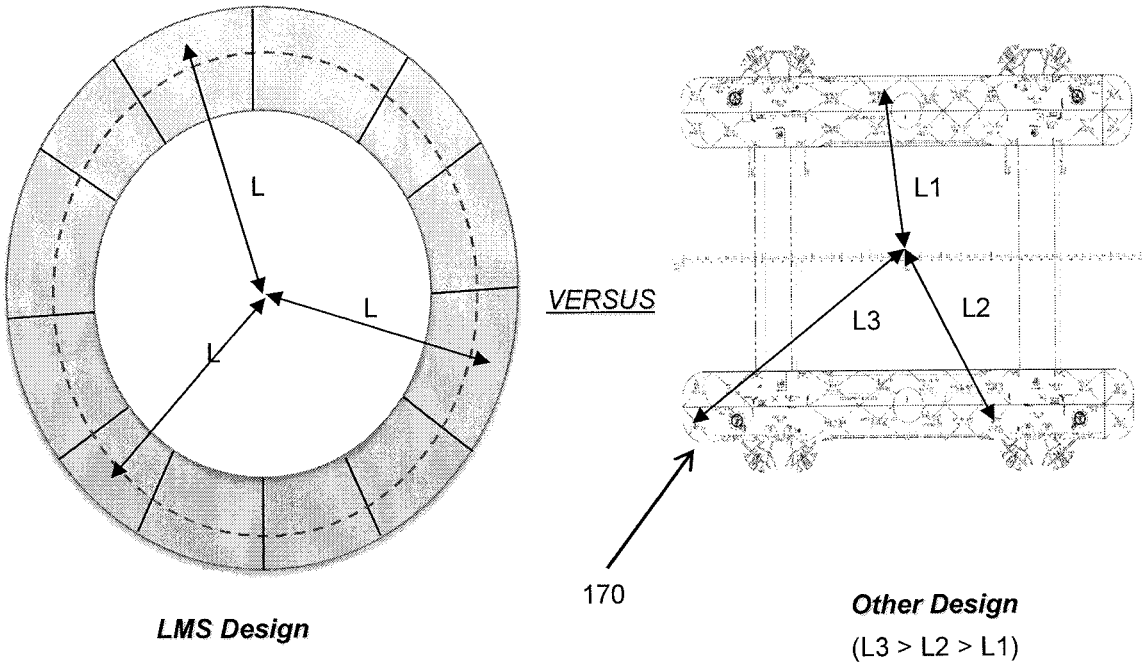
FIG. 17 shows that the symmetric circular hull design in accordance with a number of embodiments of the present invention is able to provide significantly improved damage stability as compared to conventional semi-submersible.

FIG. 17 shows that the symmetric circular hull design in accordance with an embodiment of the present invention is able to provide significantly improved damage stability as compared to conventional semi-submersible. Due to the circular and symmetric shape of the hull design, all the pontoon tanks are at equidistance ('L') and nearer to producing less heeling moment and optimizing the partition bulkhead as compared to conventional semi-submersible with twin parallel pontoons. Conventional semi-submersible with twin parallel pontoons may encounter more damages in harsh offshore environments due to the pontoon tanks located at different distance. The damage of the tanks located at the distal end (170) of the pontoon may experience large heeling moment and reduces the allowable KG of the semi-submersible.

The circular or polygonal shaped deck box in accordance with some embodiments of the present invention can provide similar area in terms of utilization of space with less surface area as compared to a conventional square or rectangular shaped deck box. This means that a circular or polygonal shaped deck box can provide the same volume with lesser steel weight as compared to a square or rectangular shaped deck box, as surface area is a function of steel weight.

Figure 18:
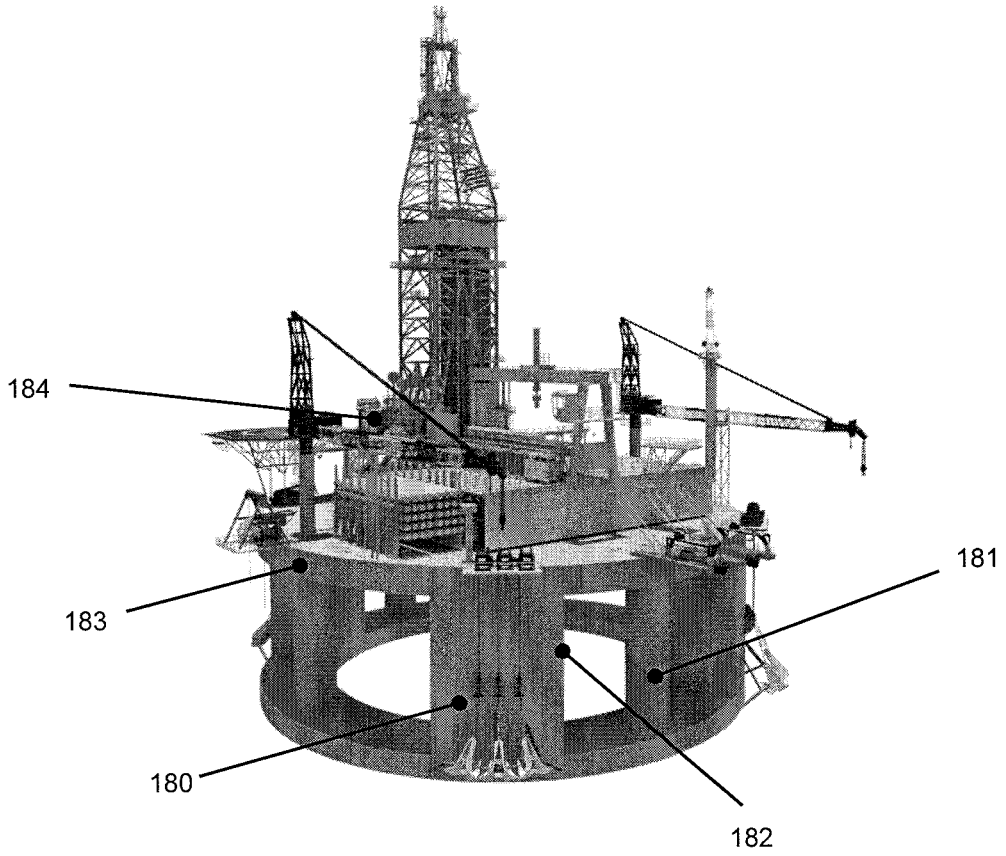
FIG. 18 shows an example of the low motion semi-submersible in accordance with an embodiment of the present invention adapted for use in drilling operation.

FIG. 18 shows a low motion semi-submersible in accordance with an embodiment of the present invention adapted for use in drilling operation. The structure shown in FIG. 18 has several advantages. It is shown that a radiated column (180) reduces current load, wave drift load and is able to protect the semi-submersible from tug boat collision due to the double skin provided as an integral part of the design. The pencil column (181) provided helps to reduce wave drift load. In order to operate in harsh offshore environment without any wave submergence to the deck box bottom, the semi-submersible is provided with higher static airgap (182) of about 20 m. The deck box design (183) is buoyant to provide reserve buoyancy in case of emergency when the semi-submersible heels. The topside layout of the deck box and the shape is improved to get reduction in wind load which results in fuel saving for dynamic position (DP) vessel and also increases in operability for moored vessel. The LQ shape has been given a circular form in order to attract lesser wind load and the aft of the LQ gets shielded by further wind load. The unique shape of LQ block (184) reduces drag coefficient and optimized windage area.

Figure 19:
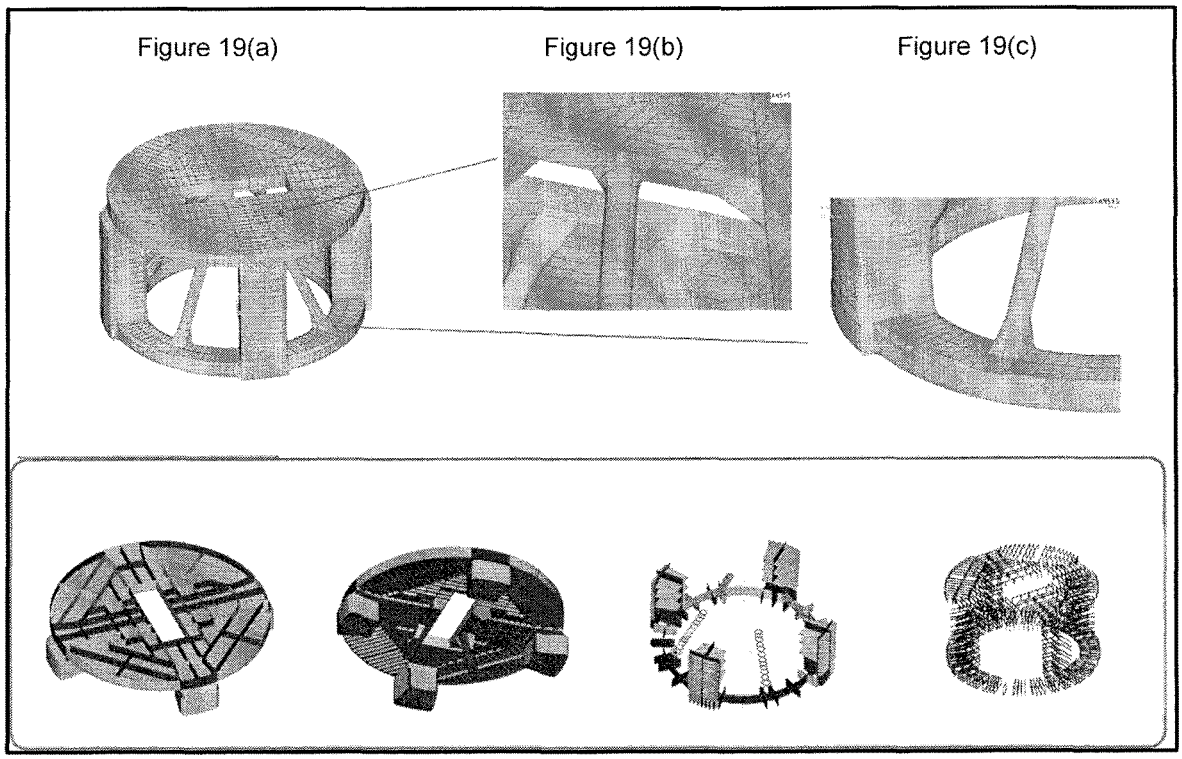
FIG. 19 shows the various views of a semi-submersible in accordance with an embodiment of the present invention.

For harsh offshore environment, fatigue is a major concern in all semi-submersible designs. In accordance with many embodiments of the present invention, no bracings are used to increase fatigue life of the semi-submersible. FIG. 19 shows the various views of the semi-submersible of the present invention. FIG. 19(*a*) shows a perspective view of the semi-submersible and FIGS. 19(*b*) and 19(*c*) show various exploded views of the pontoon structure of the semi-submersible. FIG. 19(*d*) shows the top view of the upper hull, which is also the deck box. FIG. 19(*e*) shows the bottom view of the upper hull. FIG. 19(*f*) shows the arrangement of the main columns and pencil columns and the pontoon bulkheads. FIG. 19(*g*) illustrates the major girder frames of the semi-submersible. It is clearly shown in FIG. 19 that due to the configuration of ring pontoon and the deck box, there is no need to have bracings installed to increase fatigue life of the semi-submersible.

The low motion semi-submersible in accordance with some embodiments of the present invention can be operated worldwide including, but not limited to, in harsh offshore environment, deepwater and arctic region, with higher operability and longer survivability as compared to some conventional semi-submersibles known in the art. The semi-submersible technology of the present invention can be well extended to any suitable offshore structure including, but not limited to, offshore drilling platform, production platform, accommodation platform, etc.

The low motion semi-submersible in accordance with some embodiments of the present invention has several advantages. One of which is that the semi-submersible has a deep draft (thus less wave energy). In particular, because the wave energy experienced by a semi-submersible reduces exponentially with respect to water depth, a semi-submersible having a deep draft (from 24 to 40 m) would experience diminished wave energy as compared to a semi-submersible that has a shallower draft. The draft of the semi-submersible in accordance with many embodiments of the present invention increased from 24 m to 40 m. This allows the pontoons be better submerged and as a result, improves the overall motion of the semi-submersible by at least 35%.

Another advantage of the low motion semi-submersible of the present invention is that by having pencil columns provided between two main columns, this reduces the column spacing of the semi-submersible. This helps to reduce the heave second hump to less than 0.15 m/m and improve the motion of the semi-submersible by at least 15%. FIG. 6 illustrates this advantage. It is shown that the heave second hump value is reduced when smaller column spacing is utilized on a semi-submersible. The total heave force is cancelled out when the distance between the columns (L) are equal to half the length of the wave (λ), e.g. $L=\lambda/2$. The smaller the distance between columns, more heave force is being cancelled out for smaller wavelength and wave period.

A further advantage of the low motion semi-submersible in accordance with a number of embodiments of the present invention is that having columns with water chambers help to entrap water within the pencil columns. This provides a damping action which helps to improve both the stability and motion of the semi-submersible by at least 2%. The up and down motion of the water chamber generates waves and radiates energy. Viscous damping is induced by the friction and vortex shedding between the water and the inner surface of the pencil column. The water entrapped within the pencil columns helps to improve both stability and motion of the semi-submersible.

The following examples are provided to further illustrate and describe particular embodiments of the present invention, and are in no way to be construed to limit the invention to the specific procedures, conditions or embodiments described therein.

EXAMPLES

Example 1

Figure 20:
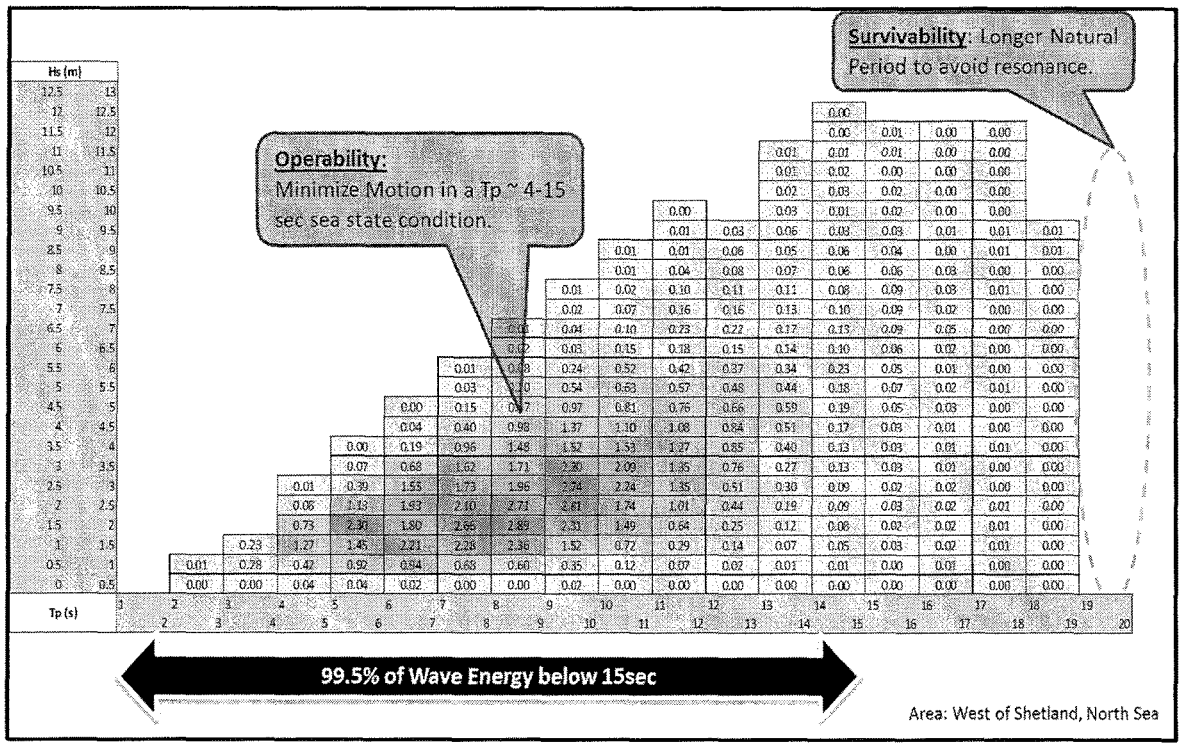
FIG. 20 is a chart showing the wave energy of the harsh environment in North Sea, West of Shetland.

FIG. 20 illustrates the harsh environment in North Sea, West of Shetland. The chart shows that 96.6% of wave energy lies within the wave period of 14 seconds, and 99.5% of wave energy lies within the wave period of 16 seconds. The heave second hump needs to be minimized in the wave period between 5 to 16 seconds to increase the operability of the semi-submersible. Further, the heave natural period needs to be more than 19 seconds to avoid resonance.

The low motion semi-submersible in accordance with some embodiments of the present invention is able to achieve the desirable results. In particular, the semi-submersible in accordance with many embodiments of the present invention is able to achieve a heave second hump of less than 0.15 m/m and a heave natural period of about 19.3 to 20.5 seconds. This is attributed to the semi-submersible having a reduced column spacing (L) which results in motion cancellation, thus reduces the second hump value to less than 0.15 m/m. The increased added mass of the ring pontoon increases the heave natural period to the desired range.

Example 2

Figure 21:
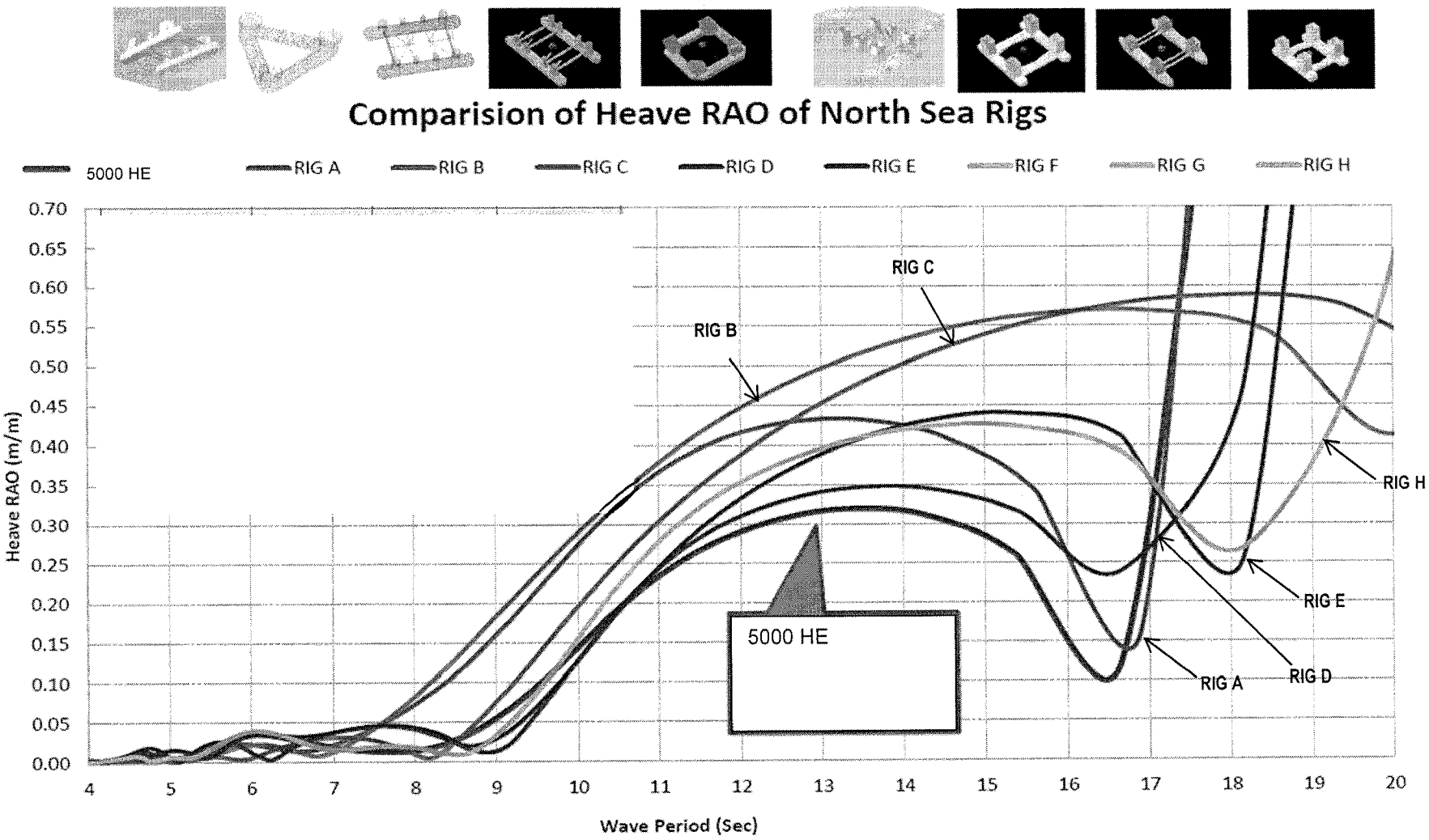
FIG. 21 illustrates the heave Response Amplitude Operator (RAO) of the various conventional semi-submersibles (including the semi-submersible shown in FIG. 1) as the wave period increases.

FIG. 21 illustrates the heave Response Amplitude Operator (RAO) of various conventional semi-submersibles (including the semi-submersible shown in FIG. 1) as the wave period increases. It is shown that the conventional semi-submersible of FIG. 1 has a relatively lower heave RAO (i.e. better motion control) as compared to the other conventional semi-submersible designs and thus higher uptime. In particular, the conventional semi-submersible of FIG. 1 has a heave second hump of about 0.32 m/m.

Example 3

Figure 22:
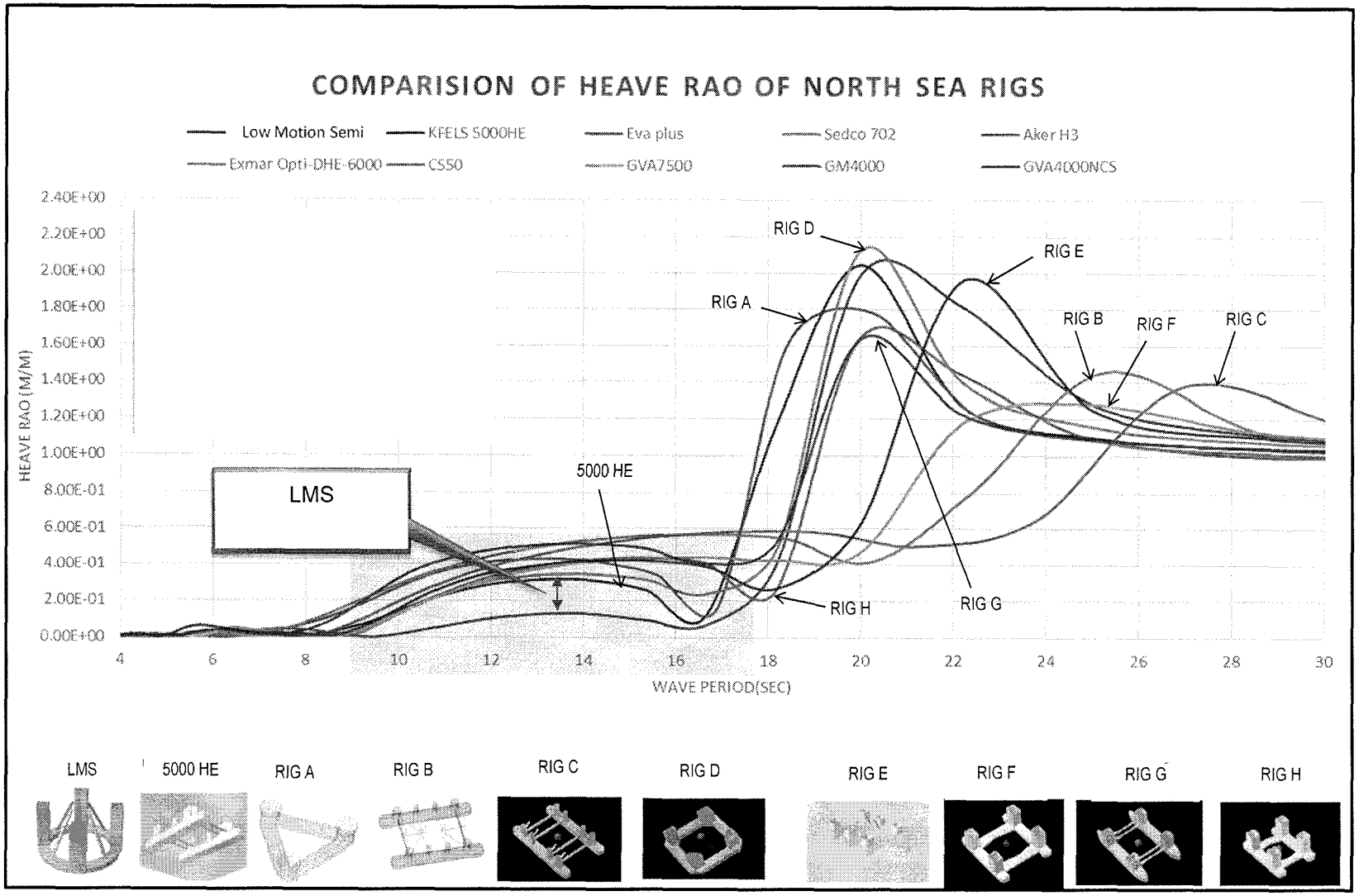
FIG. 22 is a graph that compares the operational draft, heave natural period and heave second hump of the low motion semi-submersible in accordance with an embodiment of the present invention with some other conventional semi-submersibles.

FIG. 22 is a graph that compares the operational draft, heave natural period and heave second hump of the low motion semi-submersible ('LMS') in accordance with an embodiment of the present invention and some other conventional semi-submersibles. As shown in the graph, the low motion semi-submersible (LMS) has better heave, pitch and roll motion as compared to the conventional semi-submersibles which results in the low motion semi-submersible having a higher operational uptime as compared to the other conventional designs.

The readings of the operational draft, heave natural period and heave second hump of the semi-submersibles are shown in Table 2 below:

TABLE 2

| | Operational Draft (m) | Heave Natural Period (sec) | Heave Second Hump (m/m) |
|---|---|---|---|
| LMS | 40 | 20.5 | 0.13 |
| 5000HE | 24.0 | 19.1 | 0.32 |
| Rig A | 24.8 | 19.5 | 0.43 |
| Rig B | 25.5 | 23.9 | 0.57 |
| Rig C | 21.3 | 26.0 | 0.59 |
| Rig D | 23.8 | 19.7 | 0.35 |
| Rig E | 23.5 | 22.8 | 0.45 |
| Rig F | 2.0 | 22.2 | 0.44 |
| Rig G | 17.8 | 19.1 | 0.52 |
| Rig H | 23.2 | 21.0 | 0.42 |

Example 4

The table below compares the various aspects of the low motion semi-submersible ('LMS') in accordance with an embodiment of the present invention with a conventional semi-submersible having twin parallel pontoons.

TABLE 3

| Areas | Conventional Semi-Submersible | LMS | Difference |
|---|---|---|---|
| Draft | 24 m | 40 m | |
| Displacement | 51530 mt | 75000 mt | |
| Heave Second Hump | 0.34 | 0.01 | 90% reduction |
| Operability | 70% | 90% | 20% increase |
| Wave Load | 400 | 300 | 20% reduced |
| Wind Load | 4400 | 3000 | 30% reduced |
| Current Load | 1200 | 1200 | Almost similar |
| Mooring | 12 Point Chain + 4 Thrusters | 16 Point Chain | Significant reduction in CAPEX |
| Structure | Fatigue Sensitive Area | No Fatigue Sensitive Area | Improve Design Life |
| Steel Weight | ~19000 mt | ~25900 mt | 35% increased Steel Weight |
| Transit Speed | Higher Speed | Lower Speed | Reduced transit speed |

In summary, the lower motion semi-submersible of the present invention is able to achieve a 90% reduction of heave second hump, 20% increment of operability, 20% reduction in wave load, 30% reduction in wind load, has almost similar current load, a significant reduction in CAPEX in mooring design, an improvement in the semi-submersible life as there is no fatigue sensitive area in the structure, a 35% increment of steel weight and reduction of transit speed.

The above is a description of the subject matter the inventors regard as the invention and is believed that others can and will design alternative systems that include this invention based on the above disclosure.

The invention claimed is:

1. A semi-submersible offshore structure, comprising:

a deck box;

a submersible lower hull comprising a ring pontoon having an annular pontoon body with a top surface, a bottom surface, an outer circumferential wall, an inner circumferential wall, and a plurality of spaced-apart through holes extending from the bottom surface of the ring pontoon to the top surface of the ring pontoon;

a plurality of main columns extending upwardly from the pontoon body to the deck box for supporting the deck box above a water surface; and a plurality of pencil columns, each of the pencil columns having an upper end and a lower end, with each of the pencil columns positioned between two main columns and extending upwardly from the respective spaced-apart through hole to the deck box; and wherein each of the pencil columns having a water chamber provided within the pencil column for receiving water through the through hole and entrapping water within the pencil column for dampening pitch and wave motions of the semi-submersible during operation and a piston within and at the upper end of the pencil column for entrapping air within the pencil column for use as a damper to the water entering the pencil column.

2. The semi-submersible offshore structure according to claim 1, wherein each of the pencil columns further comprises a dampening means that includes the piston for dampening water that enters the pencil column.

3. The semi-submersible offshore structure according to claim 2, wherein the dampening means includes a second chamber provided within and at the upper end of the pencil column for entrapping air within the pencil column for use as a damper to the water entering the pencil column.

4. The semi-submersible offshore structure according to claim 2, wherein the water chamber extends through the entire length of the pencil column.

5. The semi-submersible offshore structure according to claim 4, further comprising:

means for introducing compressed-air into the pencil columns for controlling flow of water within the pencil columns, wherein the said means is provided outside and proximate the upper end of the pencil column.

6. The semi-submersible offshore structure according to claim 1, wherein the plurality of pencil columns extend radially inwardly toward a center vertical axis of the ring pontoon to the deck box.

7. The semi-submersible offshore structure according to claim 1, wherein the plurality of main columns and the plurality of pencil columns having the same height.

8. The semi-submersible offshore structure according to claim 1, wherein the water chamber within the pencil column having an internal diameter of 4 to 6.5 m.

9. The semi-submersible offshore structure according to claim 1, wherein the each of the plurality of pencil columns having an internal diameter of 5 to 7 m.

10. The semi-submersible offshore structure according to claim 1, wherein each of the plurality of main columns having, over its entire length, a substantially trapezoidal or rectangular cross-section.

11. The semi-submersible offshore structure according to claim 1, wherein each of the plurality of pencil columns having, over its entire length, a substantially circular cross-section.

12. The semi-submersible offshore structure according to claim 1, wherein the ring pontoon having an outer diameter of 90 to 110 m.

13. The semi-submersible offshore structure according to claim 1, wherein the ring pontoon having an inner diameter of 65 to 85 m.

14. The semi-submersible offshore structure according to claim 1, wherein the ring pontoon has a circular or polygonal shape.

15. The semi-submersible offshore structure according to claim 1, wherein the semi-submersible has a draft of 34 to 40 m.

16. The semi-submersible offshore structure according to claim 1, wherein the semi-submersible has pontoon depth of 6 to 10 m.

17. The semi-submersible offshore structure according to claim 1, wherein the deck box having a circular or polygonal shape.

18. The semi-submersible offshore structure according to claim 1, wherein the semi-submersible offshore structure comprises four main columns and four pencil columns.

* * * * *